US006298748B1

(12) United States Patent
Rixon et al.

(10) Patent No.: US 6,298,748 B1
(45) **Date of Patent: *Oct. 9, 2001**

(54) ELECTRONIC ADJUSTABLE PEDAL ASSEMBLY

(75) Inventors: Christopher J. Rixon, Tecumseh (CA); Christopher Bortolon, Clawson, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/589,237

(22) Filed: Jun. 7, 2000

Related U.S. Application Data

(63) Continuation of application No. 09/315,751, filed on May 20, 1999, which is a continuation-in-part of application No. 09/057,956, filed on Apr. 9, 1998, now Pat. No. 5,964,125, which is a continuation of application No. 08/516,050, filed on Aug. 17, 1995, now Pat. No. 5,819,593, which is a continuation-in-part of application No. 08/513,017, filed on Aug. 9, 1995, now Pat. No. 5,632,183.

(51) Int. Cl.[7] ..... G05G 1/14
(52) U.S. Cl. ..... 74/512; 74/514
(58) Field of Search ..... 74/512, 513, 514, 74/560

(56) References Cited

U.S. PATENT DOCUMENTS

| | | |
|---|---|---|
| 2,381,390 | 8/1945 | Vanke . |
| 3,151,499 | 10/1964 | Roe . |
| 3,319,487 | 5/1967 | Lystad et al. . |
| 3,359,821 | 12/1967 | Beardsley et al. . |
| 3,643,524 | 2/1972 | Herring . |
| 3,643,525 | 2/1972 | Gibas . |
| 3,958,677 | 5/1976 | Spanelis . |
| 3,988,945 | 11/1976 | Fasano . |
| 4,005,617 | 2/1977 | Sourbel et al. . |
| 4,582,653 | 4/1986 | Blanchard et al. . |
| 4,640,248 | 2/1987 | Stoltman . |
| 4,800,774 | 1/1989 | Hagiwara et al. . |
| 4,869,220 | 9/1989 | Imoehl . |
| 4,870,871 | 10/1989 | Ivan . |
| 4,875,385 | 10/1989 | Sitrin . |
| 4,905,544 | 3/1990 | Ganoung . |
| 4,907,468 | 3/1990 | Hagiwara et al. . |
| 4,912,997 | 4/1990 | Malcolm et al. . |
| 4,915,075 | 4/1990 | Brown . |
| 4,944,269 | 7/1990 | Imoehl . |
| 4,958,607 | 9/1990 | Lundberg . |
| 4,976,166 | 12/1990 | Davis et al. . |
| 4,989,474 | 2/1991 | CIcotte et al. . |

(List continued on next page.)

*Primary Examiner*—Mary Ann Green
(74) *Attorney, Agent, or Firm*—Howard & Howard

(57) ABSTRACT

An adjustable pedal assembly is adapted to be mounted on a body structure of a motor vehicle and is operative to control a vehicle system, such as a braking system or engine throttle control system, for example. The assembly includes a carrier, a support structure mounting the carrier for fore and aft movement relative to the vehicle body structure, and a drive assembly for providing the fore and aft movement of the carrier along the support structure. A pedal is operatively connected to the carrier for movement relative to the carrier that is independent of the fore and aft movement of the carrier along the support structure. The assembly is characterized by a generator having an input associated with the pedal and an output adapted to be associated with the vehicle system. The generator is operative in response to the movement of the pedal relative to the carrier and generates an electric control signal from the output that varies in magnitude in proportion to the input by the extent of movement of the pedal relative to the carrier. The control signal is proportioned to and indicative of the position of the pedal relative to the carrier.

8 Claims, 6 Drawing Sheets

U.S. PATENT DOCUMENTS

| | | | | |
|---|---|---|---|---|
| 5,010,782 | | 4/1991 | Asano et al. . | |
| 5,045,035 | | 9/1991 | Ganoung . | |
| 5,056,742 | | 10/1991 | Sakurai . | |
| 5,078,024 | | 1/1992 | Cicotte et al. . | |
| 5,086,663 | | 2/1992 | Asano et al. . | |
| 5,165,299 | | 11/1992 | Mizuma et al. . | |
| 5,233,882 | | 8/1993 | Byram et al. . | |
| 5,241,936 | | 9/1993 | Byler et al. . | |
| 5,335,563 | | 8/1994 | Yamamoto et al. . | |
| 5,351,573 | | 10/1994 | Cicotte . | |
| 5,408,899 | | 4/1995 | Stewart . | |
| 5,460,061 | | 10/1995 | Redding et al. . | |
| 5,632,183 | * | 5/1997 | Rixon et al. | 74/512 |
| 5,697,260 | | 12/1997 | Rixon et al. . | |
| 5,722,302 | * | 3/1998 | Rixon et al. | 74/512 |
| 5,771,752 | | 6/1998 | Cicotte . | |
| 5,819,593 | | 10/1998 | Rixon et al. . | |
| 5,890,399 | * | 4/1999 | Rixon et al. | 74/512 |
| 5,964,125 | | 10/1999 | Rixon et al. . | |

* cited by examiner

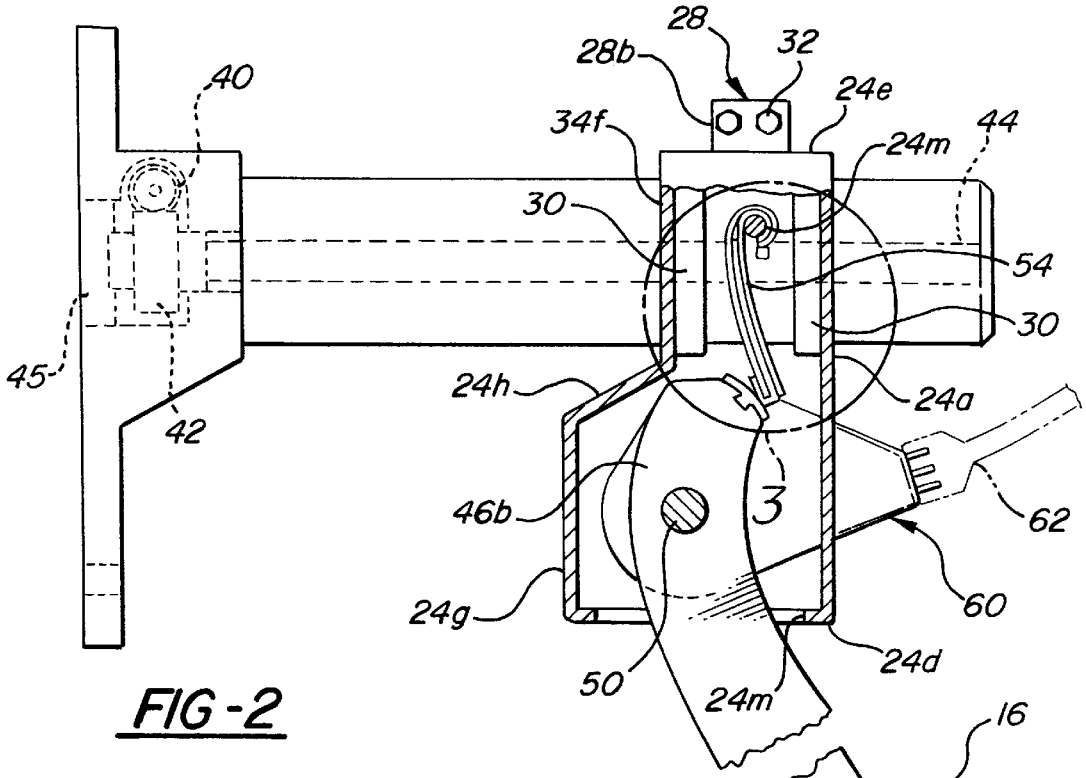
FIG-2
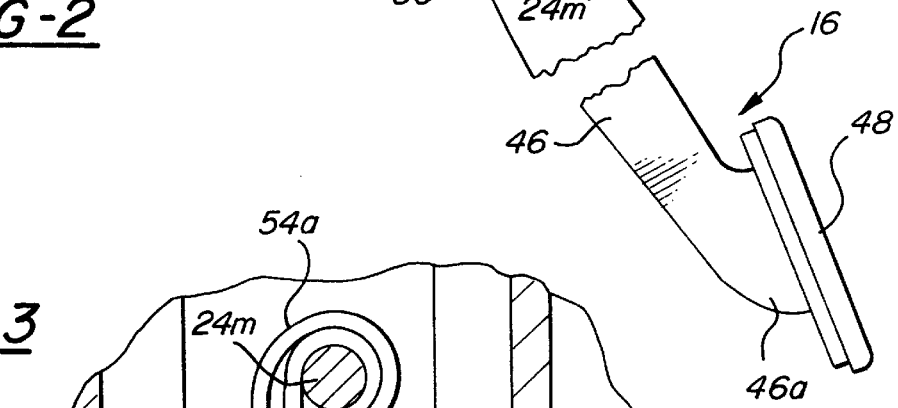
FIG-3
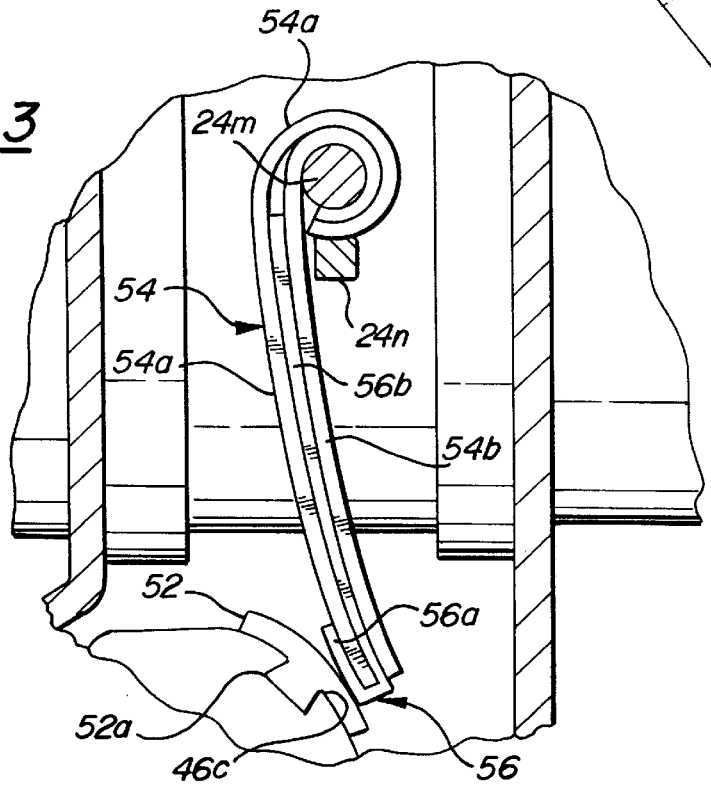

ELECTRONIC ADJUSTABLE PEDAL ASSEMBLY

RELATED APPLICATIONS

This is a continuation of Ser. No. 09/315,751 filed on May 20, 1999, which is a continuation in part of Ser. No. 09/057,956 filed on Apr. 9, 1998 now U.S. Pat. No. 5,964,125, which is a continuation of Ser. No. 08/516,050 filed on Aug. 17, 1995 now U.S. Pat. No. 5,819,593, which is a continuation-in-part of Ser. No. 08/513,017 filed Aug. 9, 1995 now U.S. Pat. No. 5,632,183.

BACKGROUND OF THE INVENTION

This invention relates to control pedal apparatuses and more particularly to adjustment means for selectively adjusting the position of one or more of the control pedals of a motor vehicle.

In a conventional automotive vehicle pedals are provided for controlling brakes and engine throttle. If the vehicle has a manual transmission a clutch pedal is also provided. These pedals are foot operated by the driver. In order for the driver to maintain the most advantageous position for working these control pedals the vehicle front seat is usually slidably mounted on a seat track with means for securing the seat along the track in a plurality of adjustment positions.

The adjustment provided by moving the seat along the seat track does not accommodate all vehicle operators due to differences in anatomical dimensions. Further, there is growing concern that the use of seat tracks, and especially long seat tracks, constitutes a safety hazard in that the seat may pull loose from the track during an accident with resultant injuries to the driver and/or passengers. Further, the use of seat tracks to adjust the seat position has the effect of positioning shorter operators extremely close to the steering wheel where they are susceptible in an accident to injury from the steering wheel or from an exploding air bag. It is therefore desirable to either eliminate the seat track entirely or shorten the seat track to an extent that it will be strong enough to retain the seat during an impact. Shortening or eliminating the seat track requires that means be provided to selectively move the various control pedals to accommodate various size drivers.

Various proposals were made over a period of many years to provide selective adjustment of the pedal positions to accommodate various size drivers but none of these proposals met with any significant commercial acceptance since the proposed mechanisms were unduly complex and expensive and/or were extremely difficult to operate and/or accomplished the required pedal adjustment only at the expense of altering other critical dimensional relationships as between the driver and the various pedals. Recently a control pedal mechanism has been developed which is simple and inexpensive and easy to operate and that accomplishes the required pedal adjustment without altering further critical dimensional relationships as between the driver and the various pedals. This control pedal mechanism is disclosed in U.S. Pat. Nos. 4,875,385; 4,989,474 and 5,078,024 all assigned to the assignee of the present application. The present invention represents further improvements in adjustable control pedal design and specifically relates to an adjustable control pedal apparatus which is compatible with, and incorporates, a drive-by-wire arrangement in which the link between the pedal and the associated controlled device of the motor vehicle comprises an electronic signal rather than a mechanical linkage.

SUMMARY OF THE INVENTION

This invention is directed to the provision of a simple, inexpensive and effective apparatus for adjusting the control pedals of a motor vehicle.

More specifically, this invention is directed to the provision of an adjustable control pedal apparatus that is especially suitable for use in conjunction with a drive-by-wire throttle or brake control.

The invention apparatus is adapted to be mounted on the body structure of the motor vehicle and includes a carrier, guide means mounting the carrier for fore and aft movement relative to the body structure, and drive means operative to move the carrier along the guide means. According to the invention, the pedal assembly further includes a pedal structure mounted on the carrier for movement relative to the carrier and means operative in response to movement of the pedal structure on the carrier to generate an electrical signal proportioned to the extent of movement of the pedal structure on the carrier. This arrangement provides a simple and effective means of generating an electronic control signal on an adjustable pedal assembly and ensures that the ergonomics of the control pedal will not vary irrespective of the position of adjustment of the pedal structure.

According to a further feature of the invention, the pedal structure is pivotally mounted on the carrier and the electric signal is generated in response to pivotal movement of the pedal structure on the carrier. This specific arrangement retains the customary pivotal movement of the control pedal and also maintains the constant ergometric operation of the control pedal assembly.

According to a further feature of the invention, the generator means includes a potentiometer mounted on the carrier whose setting is varied in response to pivotal movement of the pedal structure on the carrier. This specific arrangement provides a simple and effective means of generating the required electronic signal to provide drive-by-wire operation.

According to a further feature of the invention, the pedal structure includes a pedal arm and a pedal mounted on a lower end of the pedal arm, and the pedal assembly further includes resistance means including a leaf spring fixedly mounted at one end thereof on the carrier and having a free end biased against an upper region of the pedal arm so as to operate to resist the pivotal movement of the pedal structure. This specific arrangement provides a simple and effective means of providing the desired feet or feedback to the operator upon movement of the pedal.

According to a further feature of the invention, the resistance means further includes a first resistance plate mounted on the upper region of the pedal arm and a second resistance plate mounted on the free end of the leaf spring and biased against the first resistance plate. This arrangement allows the resistance offered to the pivoting pedal to be varied either by varying the spring characteristics of the spring or by varying the resistance characteristics of the resistance plates.

BRIEF DESCRIPTION OF THE DRAWING

FIG. 2 is a fragmentary side view of the pedal assembly;

FIG. 3 is a detail view taken within the closed line 3 of FIG. 2;

DETAILED DESCRIPTION OF THE PREFERRED EMBODIMENT

The invention control pedal assembly, broadly considered, is intended to allow efficient fore and aft movement of the pedal assembly to accommodate operators of varying anatomical dimension and is operative to generate an electronic or drive-by-wire signal in response to pivotal movement of the pedal assembly while retaining the same ergometric operation of the pedal irrespective of the position of adjustment of the pedal.

Figure 1:
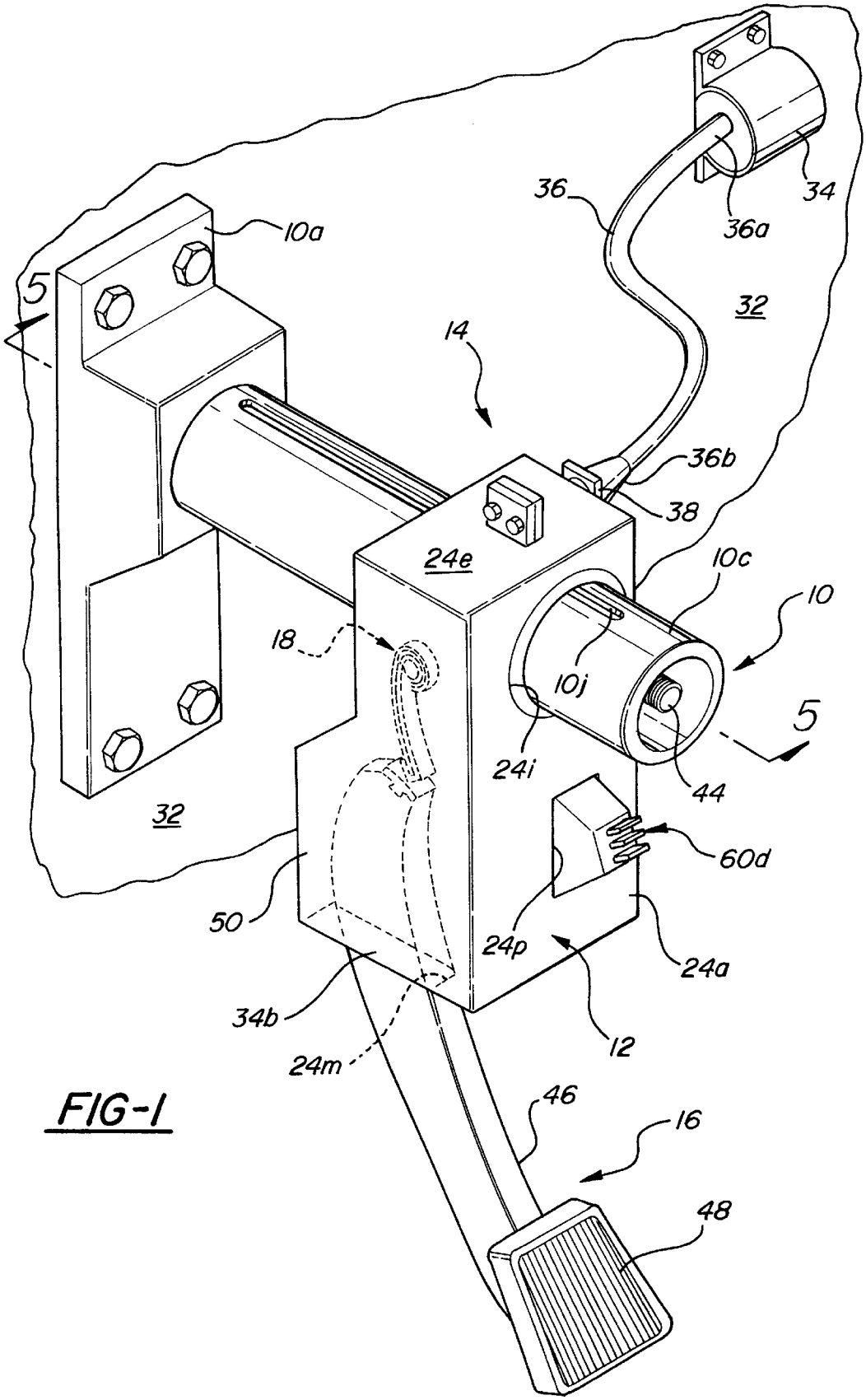
FIG. 1 is a perspective view of an electronic adjustable pedal assembly according to the invention.
Figure 6:
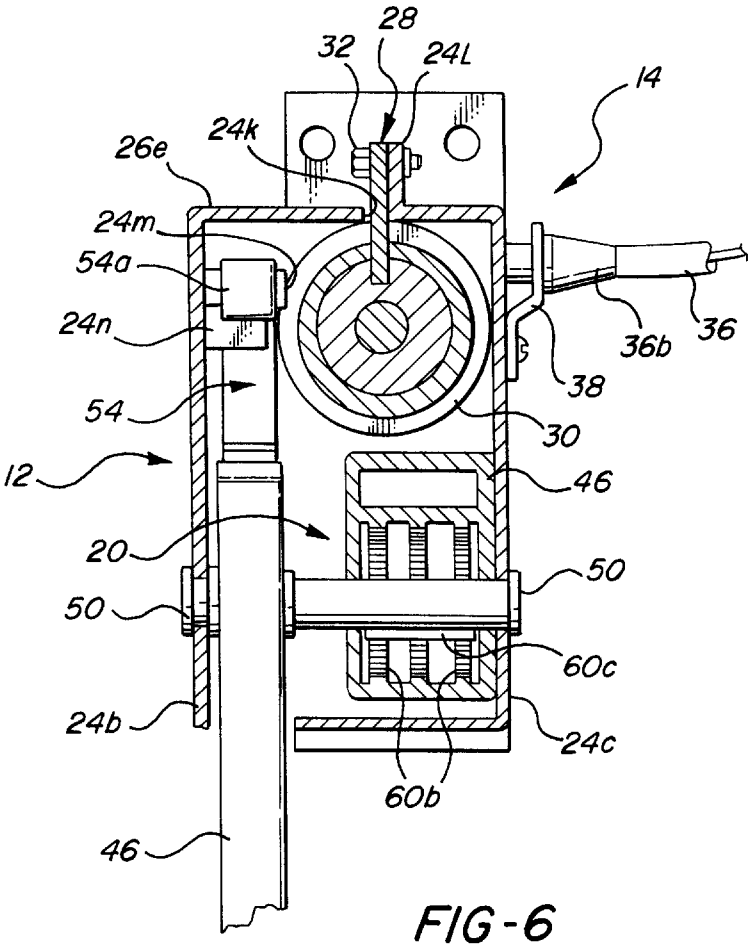
FIG. 6 is a cross-sectional view taken on line 6—6 of FIG. 5.
Figure 4:
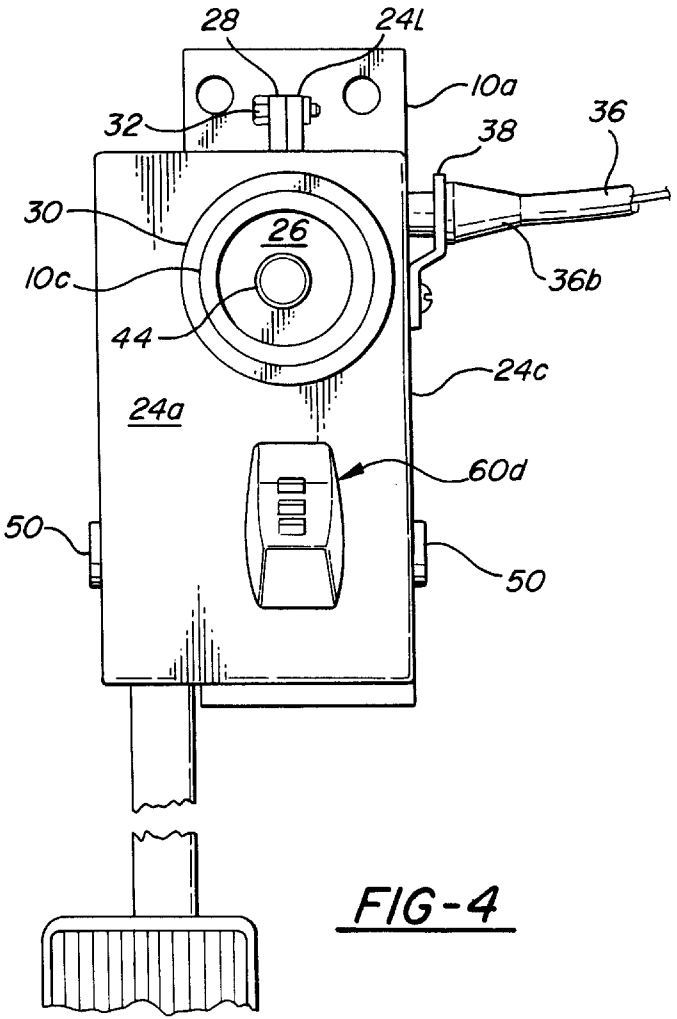
FIG. 4 is an end view of the pedal assembly.
Figure 5:
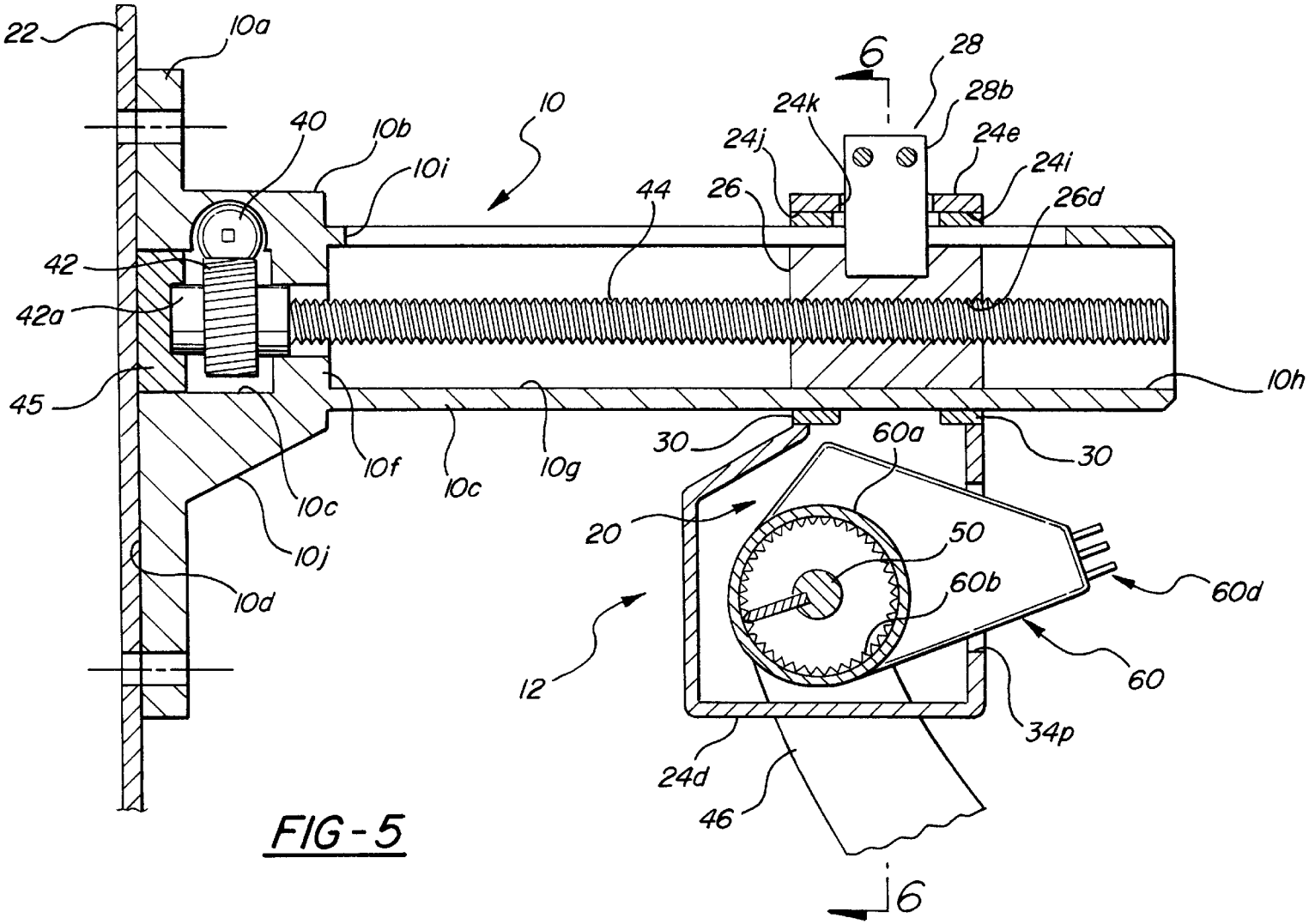
FIG. 5 is a cross-sectional view taken on line 5—5 of FIG. 1.
Figure 7:
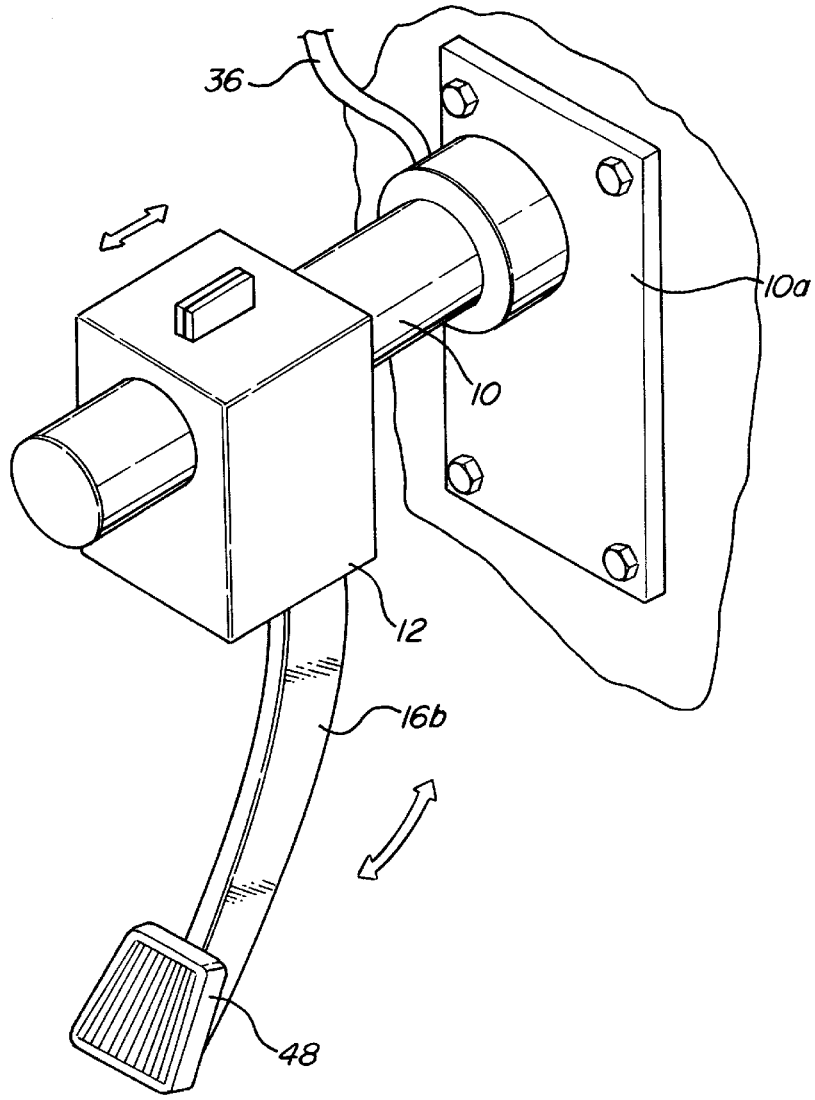
FIG. 7 is a perspective view of an electronic adjustable pedal assembly for a braking system according to the subject invention.
Figure 8:
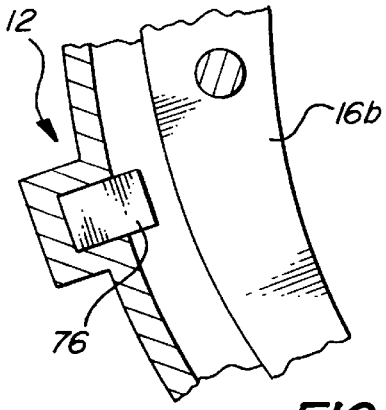
FIG. 8 is a fragmentary side view of one embodiment of an end travel limit for the pedal shown in FIG. 7.
Figure 9:
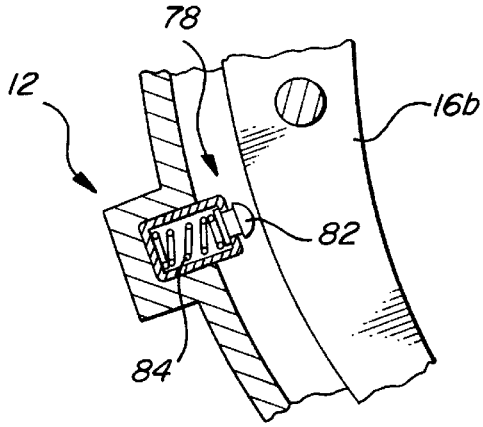
FIG. 9 is a fragmentary side view of an alternate embodiment of an end travel limit for the pedal in FIG. 7.

As shown in FIG. 1, the pedal assembly includes a support structure 10, a carrier assembly 12, a drive assembly 14, a pedal assembly 16, a resistance assembly 18, and a generator means 20. It should be understood that the pedal assembly can be either an accelerator pedal 16*a* or a brake pedal 16*b*. For description purposes, the pedal assembly shown in FIGS. 1–6 is referred to as an accelerator pedal while the pedal assembly shown in FIGS. 7–9 is referred to as a brake pedal.

Support structure 10 may be formed as two or more parts which are suitable joined together or may, as shown, be formed as a single integral unitary member in a casting or forging operation. Structure 10 includes a bracket portion 10*a*, a transmission housing portion 10*b*, and a guide rod portion 10*c*.

Bracket portion 10*a* is adapted to be suitably secured to the dash panel 22 of the associated motor vehicle utilizing suitable fastener means in known manner.

Transmission housing portion 10*b* extends rearwardly from bracket portion 10*a* and has a generally cubicle configuration defining a hollow 10*c* opening at the front face 10*d* of bracket 10*a* and further defining a central bore 10*e* in a rear wall 10*f* of the housing portion.

Guide rod portion 10*c* extends rigidly rearwardly from the rear wall 10*f* of the transmission housing portion, is hollow so as to provide a tubular configuration defining a central circular bore 10*g* concentric with bore 10*e*, is open at its rear end 10*h*, and includes an upper axial slot 10*i* extending from a location proximate the transmission housing wall 10*f* to a location proximate guide rod rear end 10*h*.

Carrier assembly 12 includes a housing 24, a nut 26, and a key 28. The carrier 12 and support structure 10 for the brake pedal 16*b* should be capable of withstanding higher loads than the carrier 12 and support structure 10 for the accelerator pedal 16*a*. For example, the carrier 12 and support structure 10 for the accelerator pedal 16*a*should be able to withstand working loads of 125 pounds (lbs) while the carrier 12 and support structure 10 for the brake pedal 16*b* should be able to withstand loading in excess of 500 lbs. Thus, the components for the brake pedal assembly 16*b* should be hardened or otherwise strengthened to operate under higher loading.

Housing 24 may be formed as a casting, forging or stamping, and is designed to move slidably along the guide rod portion 10*c* of support structure 10. Housing 24 includes a rear wall 24*a*, side walls 24*b* and 24*c*, a bottom wall 24*d*, a top wall 24*e*, and a front wall including an upper portion 24*f*, a lower portion 24*g*, and an angled intermediate connector portion 24*h*. A circular opening 24*i* is provided in rear wall 24*a* proximate top wall 24*e* and a circular opening 24*j* is provided in front wall upper portion 24*f* proximate top wall 24*e* in axial alignment with opening 24*i*. Housing 24 is mounted on the guide rod portion 10*c* of support structure 10 with guide rod portion 10*c* passing through apertures 24*i* and 24*j* and bushings 30 positioned in apertures 24*i* and 24*j* in sliding engagement with the outer periphery of guide rod portion 10*c* so as to mount the housing for sliding movement along the guide rod. Angled front wall 24*h* is complementary to the angled lower surface 10*j* of the transmission housing portion 10*b* of support structure 10 so that the housing 24 may move into nesting relation with respect to the support structure with the housing in its extreme forward position as seen in FIG. 1.

Nut 26 is circular, is mounted for sliding movement in circular bore 10*g* of support structure 10, and defines a central threaded bore 26*a*.

Key 28 is seated at its lower end 28*a* in a notch 26*b* in the upper periphery of nut 26 and passes upwardly through slot 10*i* and through an opening 24*k* in top housing wall 24*e* for securement at its upper end 28b, by fasteners 32, to a flange 241 upstanding from housing top wall 24*e*. Key 28 thus lockingly interconnects nut 26 and housing 24 so that movement of nut 26 in bore 10*g* is imparted to housing 24 so as to move housing 24 axially along guide rod portion 10*c*.

Drive assembly 14 includes a motor 34, a cable 36, a bracket 38, a worm 40, a worm gear 42, and a screw shaft 44.

Motor 34 comprises a suitable electric motor, with position memory if required, and is suitably secured to dash panel 22 proximate the bracket portion 10*a* of the support structure.

Cable 36 comprises a well-known bowden cable and is drivingly secured at one end 36*a* to the output shaft of motor 34. Bracket 38 is secured to an outer face of transmission housing 10*b* and mounts the other end 36*b* of cable 36.

Worm 40 is suitably journalled in transmission housing 10*b* in overlying relation to cavity 10*c* and is drivingly connected to cable end 36*b*.

Worm gear 42 is journalled in cavity 10*c* in meshing engagement with worm 40 and includes a front trunnion 42*a* journalled in a bearing 45 positioned in the open front end of cavity 10*c* and a rear trunnion 42*b* journalled in a counterbore 10*k* in transmission rear wall 10*f*.

Screw shaft 44 extends rearwardly from worm gear 42 centrally within support structure bore 10*g* and passes threadably through the threaded central bore 26*a* of nut 26.

It will be seen that actuation of motor 34 has the effect of rotating screw shaft 44 to thereby move nut 26 and housing 24 fore and aft along guide rod 10*c* with the extent of forward and rearward movement defined and limited by engagement of key 28 with the front and rear ends of slot 10*i*.

Pedal assembly 16 includes a pedal arm 46 and a pedal 48 secured to the lower end 46*a* of the pedal arm. Pedal arm 46 passes upwardly through a slot 24 in the lower housing wall 24*d* for pivotal mounting at its upper end 46*b* to housing side walls 24*b* and 24*c* via a pivot shaft 50.

Preferably, the resistance assembly 18 includes a pedal arm friction cam plate 52, a leaf spring 54, and a spring friction cam plate 56. Resistance assembly 18 is intended to provide feedback or "feel" to the operator to replace the feedback normally provided by the mechanical linkage interconnecting the pedal and the controlled device such as the fuel throttle or brake system. With a mechanical linkage, the pedal pressure required when advancing the accelerator or brake pedal is greater than that required to maintain a fixed position. This difference is often referred to as due to the hysteresis effect. This effect is important in maintaining the accelerator pedal in position while driving at a relatively constant speed and it must also be considered in achieving a desired deceleration time. The pressure which must be applied in accelerating is easily borne but if the back pressure of an accelerator spring produced the same effect during the time it was required to retain or maintain speed it would soon become uncomfortable for the operator to maintain a relatively constant speed. The hysteresis effect provides relief. It lessens the load required to maintain a setting of the accelerator yet there is still force to cause reverse pedal action when the foot applied pressure is removed. Resistance assembly 18 provides the "feel" of a mechanical linkage including the desired hysteresis effect to relieve operator fatigue.

In order for the brake pedal to feel like a conventional pedal, it must posses a hydraulic feel or hysteresis effect. The hysteresis required in a brake pedal would generally be greater than that for an accelerator pedal. For a brake pedal application, any hysteresis mechanisms known in the art that cause reduced differential effort on the return stroke of the brake pedal can be used to produce the desired reaction for generating hydraulic feel. For example, the hysteresis mechanisms described in U.S. Pat. Nos. 5,697,260 and 5,819,593, assigned to the same assignee as this application and incorporated by reference, can both be used to generate a hysteresis effect. In U.S. Pat. No. 5,697,260, the hysteresis is provided by a spring wrapped in a plastic bushing. The spring friction on the bushing as the pedal pivots, provides the hysteresis. In U.S. Pat. No. 5,819,593, includes two (2) dissimilar plastic components held in contact by variable spring pressure. The sliding action of the one material over the other material produces the frictional force required for the application.

It should be understood, however, that components in these hysteresis mechanisms could have different configurations depending upon whether the pedal was a brake pedal or an accelerator pedal. For example, the spring or other resilient member may be larger or have a stronger spring force depending upon the desired level of hysteresis for the particular application.

Pedal arm friction cam plate 52 may be formed, for example, of a Delrin7 material and is secured to an upper cam edge 46*c* of the pedal arm via a dovetail connection 52*a*.

Spring 54 comprises a laminated leaf spring and includes a curl 54*a* at its upper end wrapped around a pin 24*m* projecting inwardly from housing side wall 24*b*. a nub 24*n* projects inwardly from housing side wall 24*b* below pin 24*m* and coacts with pin 24*m* to trap the end tip 54*b* of curl 54*a* to fixedly secure the upper end of the spring to housing side wall 24*b*.

Spring friction cam plate 56 may be formed, for example, of a glass filled nylon material and includes a working portion 56*a* suitably secured to the lower end 54*b* of leaf spring 54 and a tail portion 56*b* passing upwardly between the leaves 54*a*, 54*b* of leaf spring 54. The parts are configured such that with the pedal 48 in its upper or rest position, as seen in FIG. 1, friction plate working portion 56*a* is urged against friction plate 52 by spring 54 so as to resist pivotal movement of the pedal assembly to an operative position with the resistance being constituted both by the increasing resistance force of the spring 54 and by the frictional resistance force between plates 52 and 56*a* generated by the wiping or camming action of plate 52 against plate 56*a* as the pedal arm pivots about the axis of pivot shaft 50. Upon release of pressure on the pedal, the frictional resistance force between plates 52 and 56*a* become subtractive rather than additive with respect to the force of spring 54, thereby creating the desired hysteresis effect. The materials of cam plates 52 and may be selectively varied to selectively vary the friction levels and hence the damping or hysteresis effect provided by the rubbing plates.

As discussed above, while the resistance assembly 18 preferably includes a pedal arm friction cam plate 52, a leaf spring 54, and a spring friction cam plate 56, it should be understood that other resistance providing mechanisms known in the art, could also be used. For example, coil springs or other resilient members can interact with a friction surface to generate the hysteresis effect.

Generator means 20 comprises a potentiometer 60 positioned within the hollow of housing 24 and suitably secured to housing side wall 24*c*. Potentiometer 60 includes a central shaft, constituted by the pivot shaft 50, a housing 60*a* concentric with shaft 50, a plurality of resistance elements 60*b* mounted circumferentially around the inner periphery of housing 60*a* in side-by-side relation, a wiper arm 60*c* mounted on shaft 50 and operative to electrically slidably engage the resistance elements 60*b* in response to pivotal movement of shaft 50, and an outlet 60*d* projecting rearwardly through opening 24*p* in housing rear wall 24*a* and electrically connected to wiper 60*c* and resistance elements 60*b* in a manner such that the electrical signal appearing at the outlet 60*d* varies in proportion to the extent of pivotal movement of the pivot shaft 50. It will be seen that pivotal movement of pedal 48 has the effect of rotating pivot shaft 50 and thereby varying the electrical signal appearing at the potentiometer outlet 60*d* so that the signal appearing at outlet 60*d* is at all times proportioned to and indicative of the pivotal position of the pedal. It will be understood that electric power is suitably supplied to potentiometer 60 and an electrical conduit 62 is suitably connected to potentiometer outlet 60*d* and extends to the vehicle function or accessory, such as the vehicle throttle, that is being electrically controlled by the pedal assembly.

It should be understood that while the above potentiometer configuration is preferred, any potentiometer known in the art can be used with either the accelerator pedal or brake pedal to generate an electric signal that is proportioned to and indicative of the pivotal position of the respective pedal.

As discussed above, it is important for the electronic adjustable brake pedal 16*b*, shown in FIG. 7, to feel like a conventional pedal with mechanical linkages. At the end of a brake pedal stroke during a braking application, the conventional brake pedal does not hit a hard stop. Further movement is restricted as the brakes are operating. At this point in the brake application, a slight sponginess is felt at the brake pedal. This is caused by the hydraulic fluid running in rubber hoses expanding the hoses slightly. In order to create a similar effect with the electronic adjustable brake pedal, a stop 76 comprised of urethane rubber, shown in FIG. 8, can be mounted within the housing of the carrier 12. As the brake pedal 16*b* nears the end of the brake stroke, the pedal arm contacts the rubber stop 76, which deforms to provide the spongy feeling.

In an alternate embodiment shown in FIG. 9, the brake pedal arm can contact a high strength valve spring assembly 78 at the end of the pedal stroke. The valve spring assembly 78 includes a valve body 80 supported by the carrier housing, a plunger 82, and a spring 84 that biases the plunger 82 to an extended position. When the brake pedal 16*b* nears the end of the stroke, the pedal arm contacts the plunger 82 and compresses the spring 84 to provide the spongy feel. When the pedal arm is released, the spring 84 returns the plunger 82 to the extended position.

In operation, the position of the pedal 48 relative to the operator is selectively adjusted by selectively energizing motor 34 to selectively move nut 26 forwardly and rearwardly within guide rod bore 10*g* and thereby, via key 28, move the pedal assembly selectively forwardly and rearwardly along guide rod 10*c* with the limits of forward and rearward movement determined by engagement of the key with the respective forward and rearward ends of the slot 10*i*. The adjustment operation is performed the same way for either the brake 16*b* or accelerator pedal 16*a*. In any position of adjustment of the pedal, actuation of the pedal or release of the pedal results, in the manner previously described, in the generation of an output signal at the outlet 60*d* proportioned to the extent of pivotal movement. Since the pivotal movement of the pedal arm is precisely the same in any position of adjustment of the pedal structure, the ergometrics of the assembly do not vary irrespective of the position of adjustment of the pedal assembly and irrespective of the anatomical stature of the operator.

In the preferred embodiment, the accelerator 16*a* and brake 16*b* pedal assemblies will be simultaneously adjusted to the desired position for the operator. When the accelerator pedal 16*a* is actuated, an output signal is generated that is proportioned to the extent of pivotal movement of the accelerator pedal 16*a*. When the brake pedal 16*b* is actuated, an output signal is generated that is proportioned to the extent of pivotal movement of the brake pedal 16*b*. The electric control signals generated by the accelerator 16*a* and brake 16*b* pedals replace mechanical control linkages with "electronic" links to achieve drive-by-wire performance.

Figure 10:
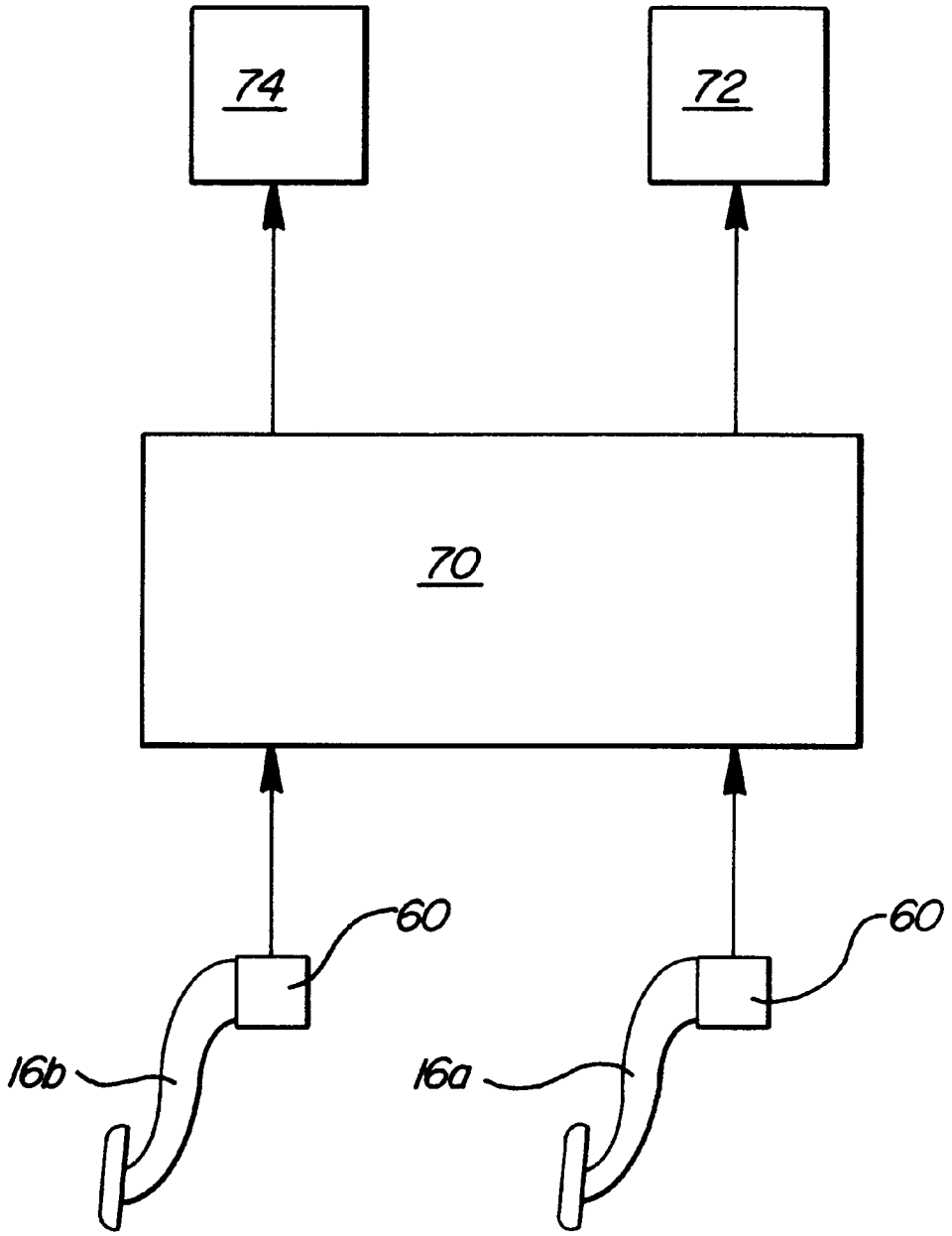
FIG. 10 is a schematic view of the drive-by-wire system.

The electric signals generated by the accelerator 16*a* and brake 16*b* pedals can be directly processed and sent to the respective control system or the signals can be processed by a central processor unit 70, such as a computer or other similar device, shown in FIG. 10. When the signals are sent to a computer 70, the signals are processed and sent to electronically control a fuel throttle system 72 or brake system 74.

As the pedal is moved downwardly, a "feel" is imparted to the pedal, simulating the feel of a mechanical linkage between the pedal and the controlled vehicle system, by the combined effect of flexing of the leaf spring 54 and frictional sliding or wiping engagement between the friction plates 52 and 56*a*. Further, as the pedal is released or allowed to return, the frictional force becomes subtractive rather than additive with respect to the spring force, thereby creating the desired hysteresis effect. The amount of feel imparted to the pedal can thus be precisely adjusted by adjusting the spring rate or other parameters of leaf spring 54, and/or by adjusting the materials or other parameters of friction plates 52 and 56, and/or by adjusting the rise of cam edge 46*c*, thereby rendering it relatively easy to fine tune the system to achieve any desired feel and any desired hysteresis effect.

The invention will be seen to provide an electronic adjustable pedal assembly for a motor vehicle in which the assembly may be readily adjusted to accommodate operators of varying anatomical dimensions and in which the ergometrics of the system remain constant irrespective of the position of adjustment of the pedal structure.

Whereas a preferred embodiment of the invention has been illustrated and described in detail, it will be apparent that various changes may be made in the disclosed embodiment without departing from the scope or spirit of the invention. For example, although the invention pedal assembly has been indicated for use in controlling the throttle of the associated vehicle, the invention pedal assembly may be used to electrically control a wide variety of vehicle functions or accessories. Further, although the resistance assembly 18 has been illustrated as providing the damping for an adjustable pedal assembly, it will be apparent that this resistance assembly can also be utilized to provide damping for a non-adjustable pedal assembly.

What is claimed is:

1. An adjustable pedal assembly for a vehicle comprising;

a support structure for mounting to a vehicle structure;

a guide member supported by said support structure;

a pedal arm supported on said guide member for rectilinear movement in fore and aft directions relative to said guide member between various adjusted positions;

a pivot supporting said pedal arm for pivotal movement relative to said support structure;

a carrier connected to said pedal arm and movably supported by said guide member;

a screw interconnecting said guide member and said carrier for moving said carrier to provide said fore and aft rectilinear movement of said pedal arm relative to said guide member and said support structure;

and said carrier being in sliding engagement with said guide member independently of said screw;

an electrical generator responsive to pivotal movement of said pedal arm about said pivot to generate an electric signal which varies in proportion to the extent of pivotal movement of said pedal arm.

2. An assembly as set forth in claim 1 wherein said carrier includes a resilient stop, said pedal arm engaging said resilient stop to define a maximum applied position.

3. An assembly as set forth in claim 1 including a resilient member actuated by said pedal arm to react against a friction surface to provide a hysteresis effect.

4. An assembly as set forth in claim 1 wherein said screw is supported by said guide member at one end and extends to an unsupported distal end.

5. An assembly as set forth in claim 1 wherein said generator is positioned on said carrier for movement with said carrier relative to said support structure.

6. An assembly as set forth in claim 5 wherein said generator includes a potentiometer mounted on said carrier and said potentiometer produces an output that varies in magnitude in proportion to said pivotal movement of said pedal arm.

7. An assembly as set forth in claim 1 wherein said carrier includes a housing having a smooth bore and a threaded bore; said guide member slidably received in said smooth bore and through said housing; and said screw being threadably received in said threaded bore for providing said fore and aft movement of said carrier along said guide member.

8. An assembly as set forth in claim 7 including a drive assembly including a motor for driving said screw and providing said fore and aft movement of said carrier along said guide member independent of said electric signal generated by said electrical generator.

* * * * *